US011771202B2

(12) United States Patent
Nakahira

(10) Patent No.: US 11,771,202 B2
(45) Date of Patent: Oct. 3, 2023

(54) COSMETIC MATERIAL FEEDING-OUT CONTAINER

(71) Applicant: Shiseido Company, Ltd., Tokyo (JP)

(72) Inventor: Yu Nakahira, Tokyo (JP)

(73) Assignee: Shiseido Company, Ltd., Tokyo (JP)

( * ) Notice: Subject to any disclaimer, the term of this patent is extended or adjusted under 35 U.S.C. 154(b) by 0 days.

(21) Appl. No.: 17/787,645

(22) PCT Filed: Dec. 14, 2020

(86) PCT No.: PCT/JP2020/046479

§ 371 (c)(1),
(2) Date: Jun. 21, 2022

(87) PCT Pub. No.: WO2021/131838

PCT Pub. Date: Jul. 1, 2021

(65) Prior Publication Data

US 2022/0408901 A1 Dec. 29, 2022

(30) Foreign Application Priority Data

Dec. 23, 2019 (JP) ..... 2019-231537

(51) Int. Cl.
*A45D 40/20* (2006.01)
*A45D 40/10* (2006.01)
*A45D 40/06* (2006.01)

(52) U.S. Cl.
CPC ..... *A45D 40/205* (2013.01); *A45D 40/06* (2013.01); *A45D 40/10* (2013.01); *A45D 2040/207* (2013.01)

(58) Field of Classification Search
CPC ..... A45D 40/205; A45D 40/06; A45D 2040/207; A45D 40/20; A45D 40/10;
(Continued)

(56) References Cited

U.S. PATENT DOCUMENTS 6,244,769 B1 * 6/2001 Nakajima ..... A45D 40/04 401/75
8,845,221 B2 * 9/2014 Fukumoto ..... B43M 11/06 401/172

FOREIGN PATENT DOCUMENTS

JP 60-048706 A 3/1985
JP 63-031609 A 2/1988
(Continued)

*Primary Examiner* — David J Walczak
(74) *Attorney, Agent, or Firm* — Foley & Lardner LLP

(57) ABSTRACT

A cosmetic material feeding-out container includes an outer tube, an inner tube disposed inside the outer tube, a cosmetic material container disposed in the inner tube with relatively moveable along a tube axial direction, an intermediate tube formed with a helical groove repeatedly on an inner circumferential face along a tube axial direction and disposed between the outer tube and the inner tube, an engagement member protruded from a portion of the cosmetic material container and engageable with the helical groove, and an operation unit including a knocking operation piece protruded from the outer tube and a rotating cam mechanism configured to rotate the intermediate tube in response to a knocking operation of the knocking operation piece, and the intermediate tube is configured to be rotated by the rotating cam mechanism to move the cosmetic material container along the tube axial direction.

5 Claims, 16 Drawing Sheets

(58) Field of Classification Search
CPC ..... A45D 2040/204; A45D 2040/208; A45D 40/00; A45D 2040/0025; A45D 40/04; A45D 40/02
USPC ..... 401/65, 66, 68, 75–78, 87, 109–112
See application file for complete search history.

(56) References Cited

FOREIGN PATENT DOCUMENTS

| | | |
|---|---|---|
| JP | 01-079410 U | 5/1989 |
| JP | 09-000347 A | 1/1997 |

* cited by examiner

10

FIG.3A
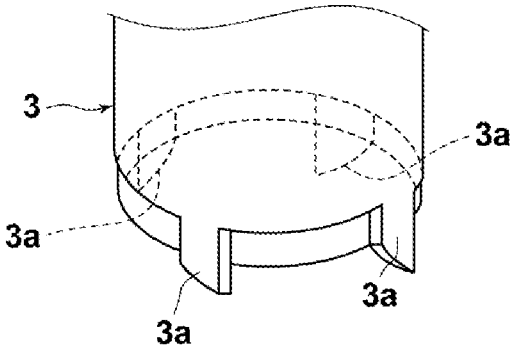
FIG.3B
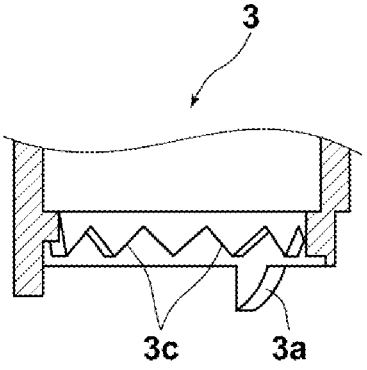
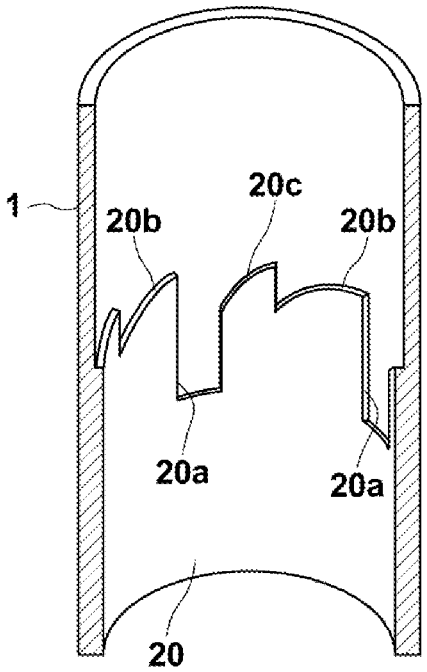
FIG.3C

10

10

FIG.16A
30
FIG.16B
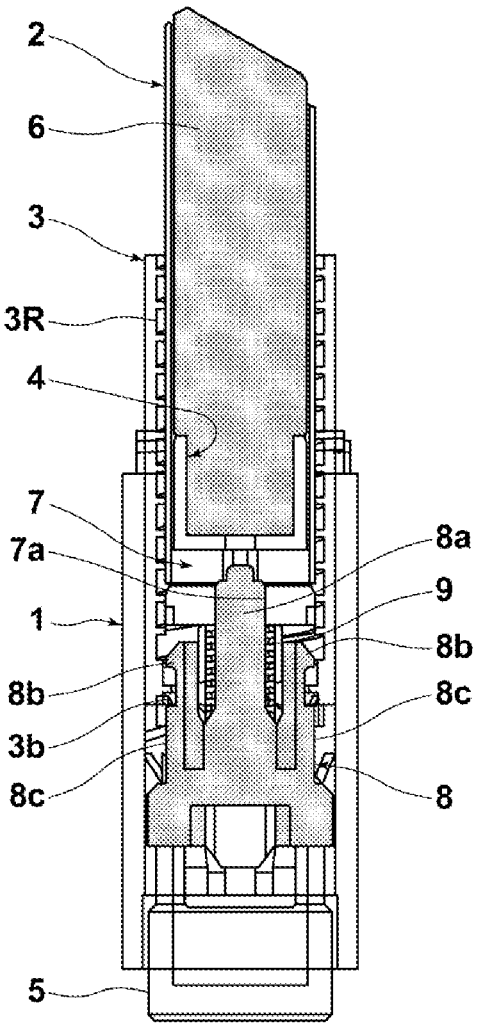
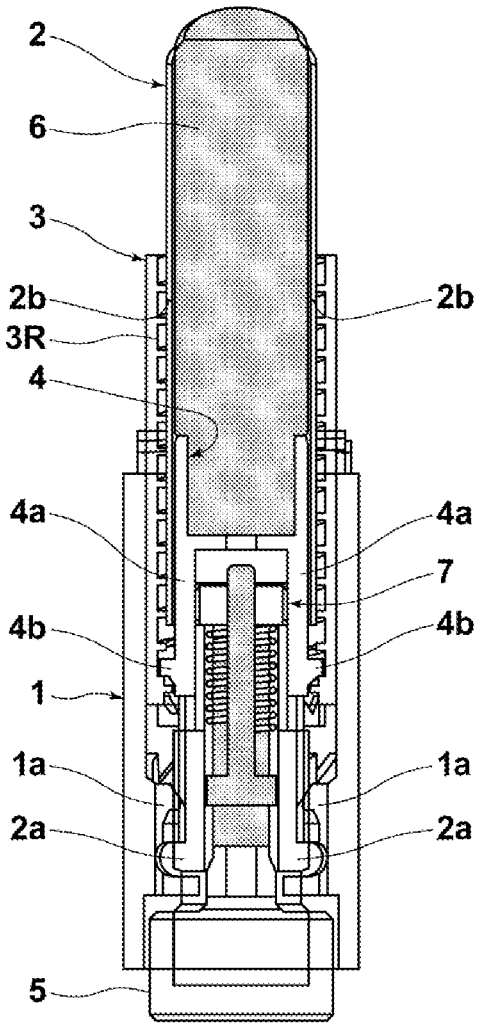

FIG.17A
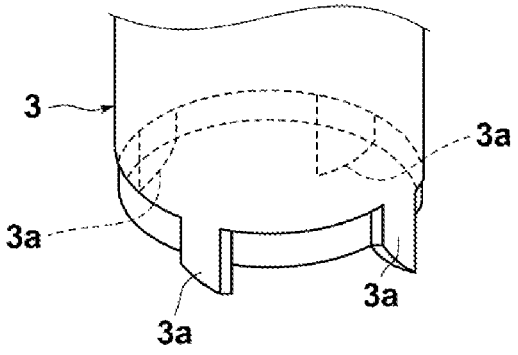
FIG.17B
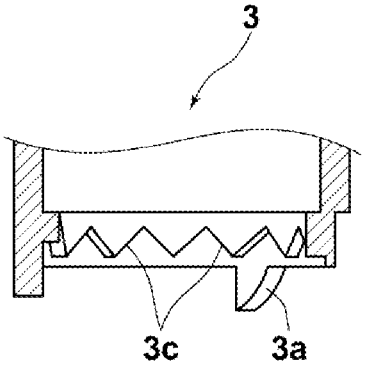
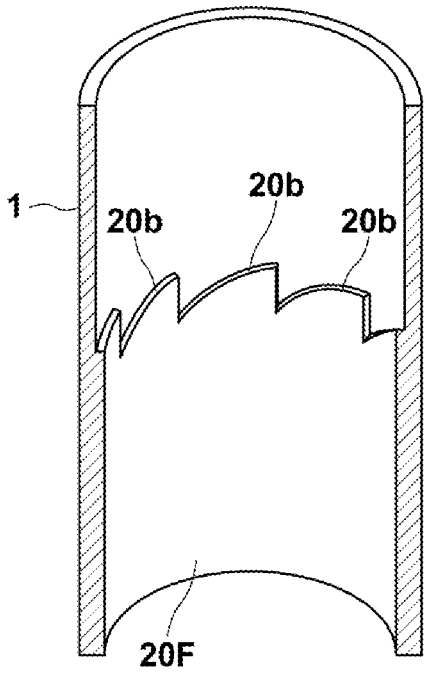
FIG.17C

COSMETIC MATERIAL FEEDING-OUT CONTAINER

CROSS REFERENCE TO RELATED APPLICATIONS

The present application is a National Phase Entry of PCT International patent Application No. PCT/JP2020/046479 filed on Dec. 14, 2020, which claims priority to Japanese Patent Application No. 2019-231537 filed on Dec. 23, 2019.

TECHNICAL FIELD

The present disclosure relates to a cosmetic material feeding-out container, and more particularly to a cosmetic material feeding-out container including an outer tube of cylindrical shape, an inner tube disposed inside the outer tube, and a cosmetic material container disposed inside the inner tube.

BACKGROUND ART

Conventional cosmetic material feeding-out containers, such as the one disclosed in Japanese Unexamined Patent Publication No. H09-347 includes a rotor disposed inside an outer tube rotatable by a rotating cam mechanism, the rotor rotatable by operating the rotating cam mechanism using a knock mechanism, and a cosmetic material holder, rotatable in response to receiving a force of the rotation and linearly moveable along a tube axial direction in response to receiving an effect of a spiral, with which a cosmetic material of stick shape is fed out from the outer tube.

This type of cosmetic material feeding-out containers perform a good operability since the cosmetic material (e.g., lipstick) can be fed out from the outer tube by simply operating the knock mechanism using only one hand.

BACKGROUND ART DOCUMENTS

Summary

However, since component elements, such as a rotatable rod, are assembled between the rotating cam mechanism and the cosmetic material holder in the conventional cosmetic material feeding-out containers of this type, a further improvement in operability, including such as adjustment of feed-out amount and retraction, may be demanded. Further, since the component elements, such as the rotatable rod, are assembled for the conventional cosmetic material feeding-out containers of this type, a further improvement in reliable operability may be demanded. The present disclosure is devised in view of the above background, and is to provide a knock-operable cosmetic material feeding-out container employing a simpler configuration and improved operability, including such as adjustment of feed-out amount and retraction.

A cosmetic material feeding-out container comprising:

an outer tube of cylindrical shape;

an inner tube disposed inside the outer tube in a state of protruding a portion of the inner tube from one end of the outer tube, being integrated with the outer tube so as not movable relative to the outer tube;

a cosmetic material container disposed inside the inner tube, movable relative to the inner tube along a tube axial direction, accommodating a base end portion of cosmetic material of stick shape, and accommodating and holding the cosmetic material such that a tip end portion of the cosmetic material directing into a direction opposite with respect to another end of the outer tube;

an intermediate tube made of a member of cylindrical shape, disposed between the outer tube and the inner tube, formed with a helical groove extended in a circumferential direction and repeating along a tube axial direction on an inner circumferential face of the member of cylindrical shape;

an engagement member protruded from a portion of the cosmetic material container and engageable with the helical groove; and an operation unit including a knocking operation piece protruded from the another end of the outer tube, and a rotation cam mechanism configured to rotate the intermediate tube in response to a knocking operation of the knocking operation piece, wherein the intermediate tube is configured to be rotated by the rotating cam mechanism in response to the knocking operation of the knocking operation piece to move the cosmetic material container into a direction opposite with respect to the another end of the outer tube.

Further, the rotating cam mechanism is preferably configured, in response to the knocking operation of the knocking operation piece, to rotate the intermediate tube and to move the intermediate tube relative to the inner tube along the tube axial direction.

Further, as to the rotating cam mechanism configured as above described, the inner tube is, particularly and preferably, provided with a guide space, formed by cutting away a portion of a tube wall of the inner tube and being extended along a tube axial direction, and the engagement member is moveable within the guide space.

Further, the above-described engagement member preferably includes two engagement members being protruded in opposite directions with the center of the cosmetic material container interposed between the two engagement members.

The cosmetic material feeding-out container of the present disclosure employs a configuration such that the cosmetic material container is directly moveable along the cosmetic material feeding-out direction using the intermediate tube rotatable by the rotating cam mechanism in response to a knocking operation, with which the configuration can be made in simple and the operability, including such as adjustment of feed-out amount and retraction, can be improved.

BRIEF DESCRIPTION OF THE DRAWINGS

FIG. 3A is a perspective view illustrating one portion of the cosmetic material feeding-out container of FIG. 1 from an outer side.

FIG. 3B is a partial cross-sectional side view illustrating the one portion of the cosmetic material feeding-out container of FIG. 1 from an inner side.

FIG. 3C is a cross sectional perspective view illustrating another portion to be assembled with the one portion of the cosmetic material feeding-out container of FIG. 1.

FIG. 16A is a cross-sectional side view of the cosmetic material feeding-out container of FIG. 15.

FIG. 16B is a cross-sectional front view of the cosmetic material feeding-out container of FIG. 15.

FIG. 17A is a perspective view illustrating one portion of the cosmetic material feeding-out container of FIG. 15 from an outer side.

FIG. 17B is a partial cross-sectional side view illustrating the one portion of the cosmetic material feeding-out container of FIG. 15 from an inner side.

FIG. 17C is a cross sectional perspective view illustrating another portion to be assembled with the one portion of the cosmetic material feeding-out container of FIG. 15.

EMBODIMENTS

Figure 1:
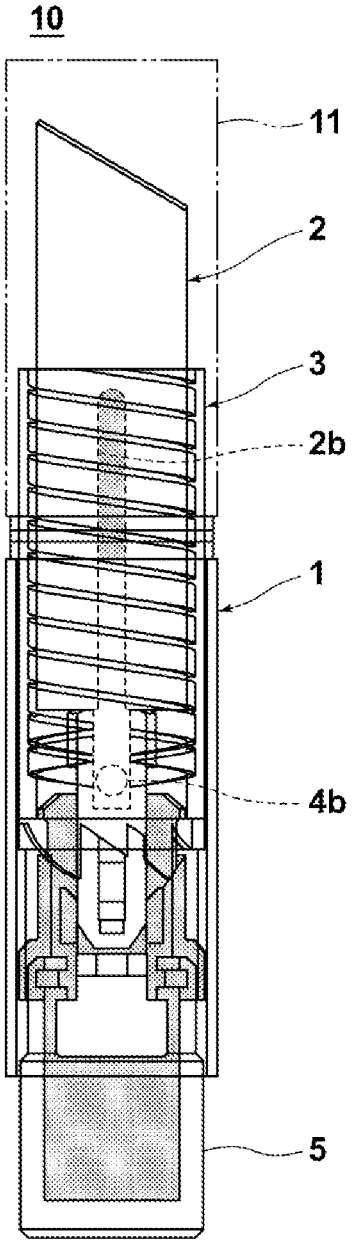
FIG. 1 is a side view illustrating a cosmetic material feeding-out container according to a first embodiment of the present disclosure.
Figure 2A:
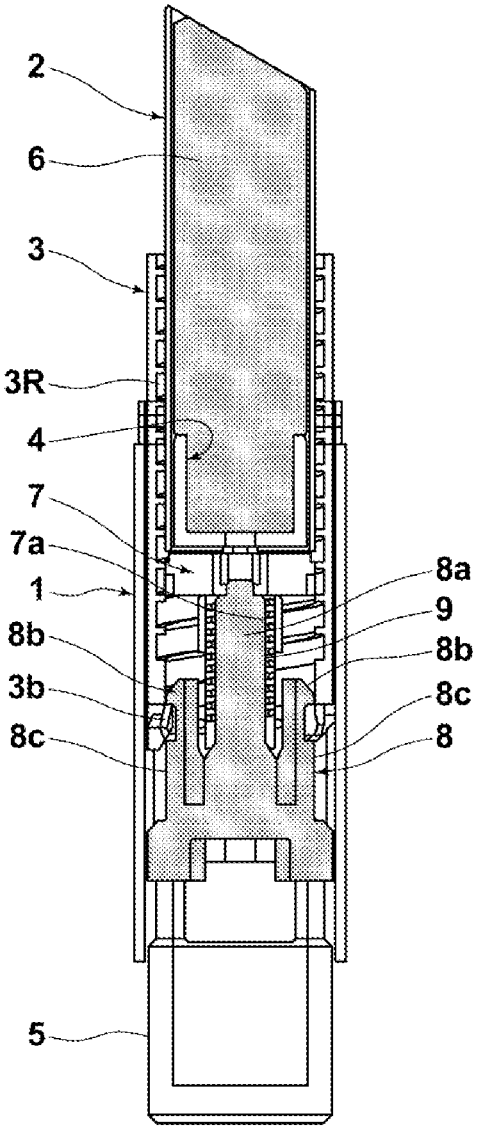
FIG. 2A is a cross-sectional side view of the cosmetic material feeding-out container of FIG. 1.
Figure 2B:
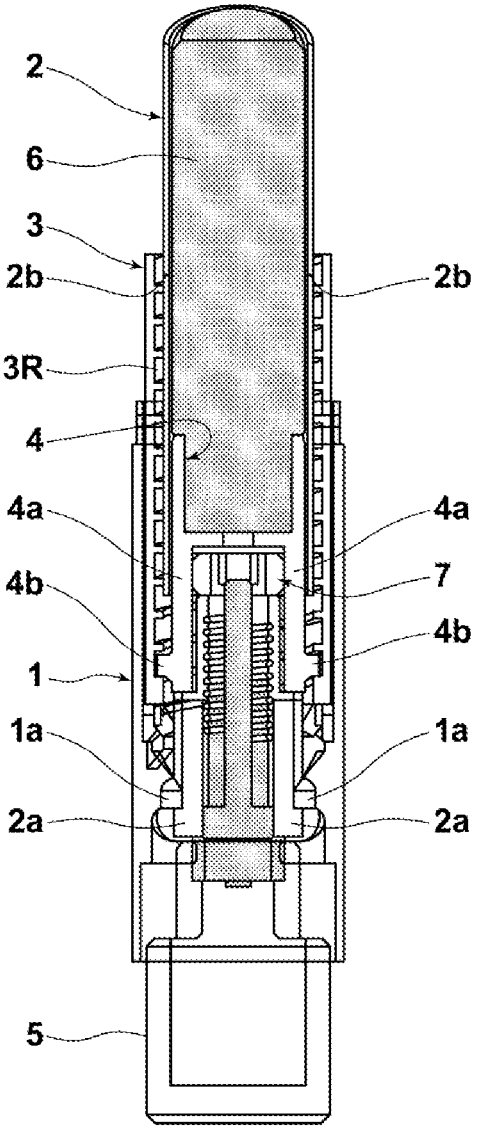
FIG. 2B is a cross-sectional front view of the cosmetic material feeding-out container of FIG. 1.
Figure 13:
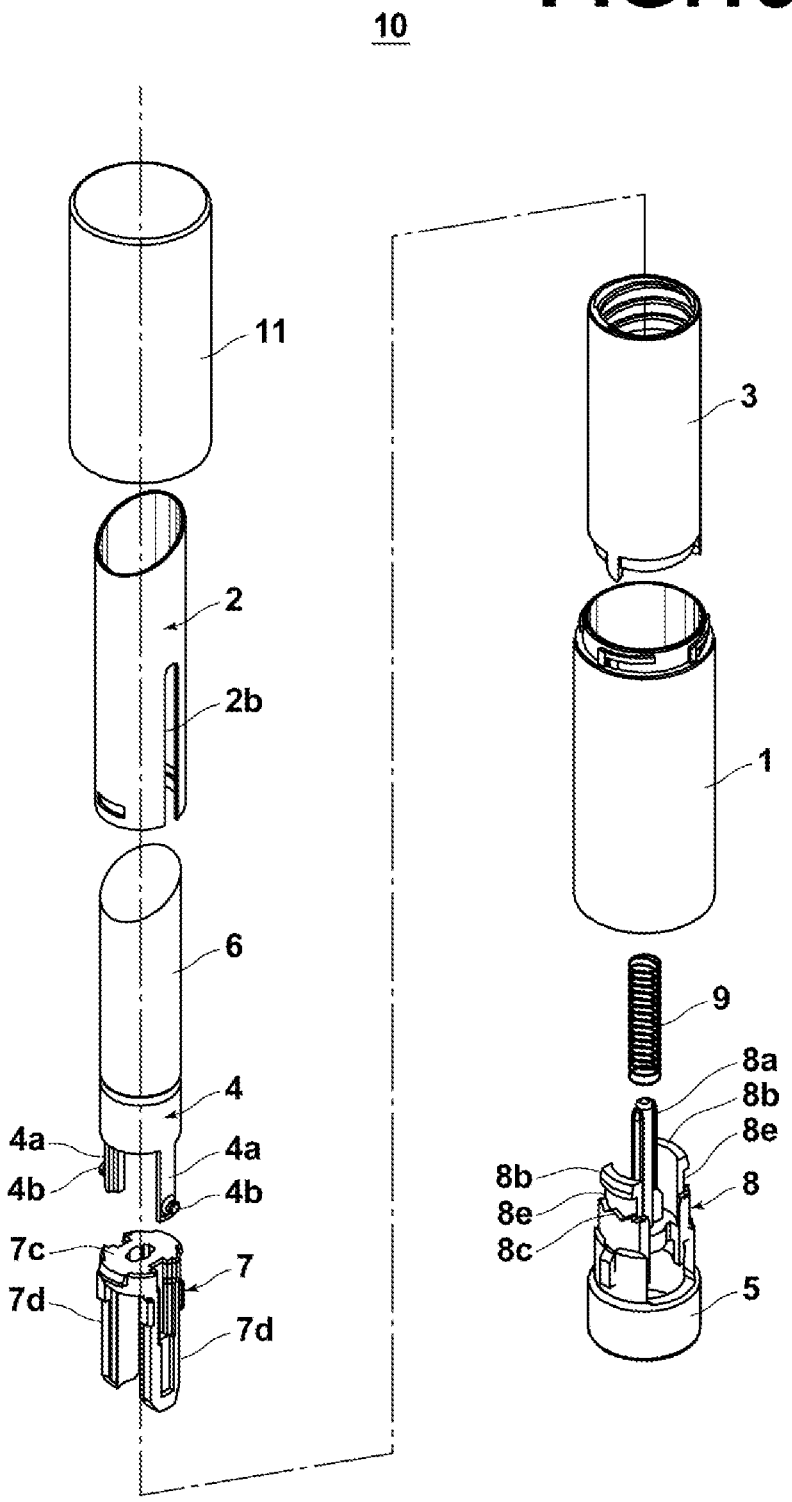
FIG. 13 is an exploded perspective view of the cosmetic material feeding-out container of FIG. 1, illustrating each of component parts disassembled separately.

Hereinafter, a description is given of embodiments of the present disclosure with reference to the drawings. FIG. 1 is a side view illustrating an external appearance of a cosmetic material feeding-out container 10 according to a first embodiment of the present disclosure, and FIGS. 2A-2B are is a longitudinal cross-sectional views illustrating one state of the cosmetic material feeding-out container 10. FIG. 2A and FIG. 2B, respectively, illustrate a cross-sectional side view and a cross-sectional front view of the cosmetic material feeding-out container 10. As illustrated in the drawings, the cosmetic material feeding-out container 10 includes an outer tube 1 of a substantially cylindrical shape, an inner tube 2 of substantially cylindrical shape disposed inside the outer tube 1 in a state of protruding a portion of the inner tube 2 from one end of the outer tube 1 (the upper end in the drawing), an intermediate tube 3 of substantially cylindrical shape disposed between the outer tube 1 and the inner tube 2, a cosmetic material container 4 having a bottom and substantially cylindrical shape disposed inside the inner tube 2 with relatively movable along a tube axial direction (the vertical direction in the drawing), and a knocking operation piece 5 protruded from another end of the outer tube 1, that is, the lower end in the drawing. Further, the cross-sectional side view illustrated in FIG. 2A and the cross-sectional front view illustrated in FIG. 2A indicate cross-sectional shapes including the central axis of the outer tube 1, and plane views orthogonal to each other. Further, FIG. 13 illustrates an exploded perspective view of component parts 1 to 9 disposed inside the outer tube 1, and a component part 11 by disassembling the cosmetic material feeding-out container 10.

As illustrated in FIG. 2B, the inner tube 2 includes, for example, two partial extended members 2*a* provided at an angular pitch of 180 degrees (°) each other and extended downwardly. The extended members 2*a* are linked with a link portion 1*a* extended toward the center of the outer tube 1 at the lower portion of the outer tube 1. With this configuration, the inner tube 2 is integrated with the outer tube 1, and thus is prevented from moving relative to the outer tube 1. Further, the inner tube 2 includes, for example, a total of two guide spaces 2*b*, each formed by cutting away a portion of a tube wall of the inner tube and extended in parallel to a tube axial direction of the inner tube 2 at an angular pitch of 180 degrees with respect to each other. In FIG. 2B, a portion indicated by "2*b*" is the upper end edge of the guide space 2*b*.

Further, the cosmetic material container 4, disposed inside the inner tube 2, accommodates a base end portion of the cosmetic material 6 of stick-shape (lower end portion in the drawing), and accommodates and holds the cosmetic material 6 in a state of directing a tip end portion (upper end portion in the drawing) of the cosmetic material 6 into a direction opposite with respect to another end of the outer tube 1, that is, toward the upper end in the drawing. As illustrated in FIG. 2B, the lower portion of the cosmetic material container 4 is provided with two partial extended members 4*a*. Each of the extended members 4*a* is provided with an engagement member 4*b* protruded radially outward, and each of the engagement member 4*b* is moveable within the guide space 2*b* of the inner tube 2. With this configuration, whereas the cosmetic material container 4 is moveable linearly along the tube axial direction of the inner tube 2, the cosmetic material container 4 cannot perform a relative rotation about the tube axis of the inner tube 2.

Figure 14:
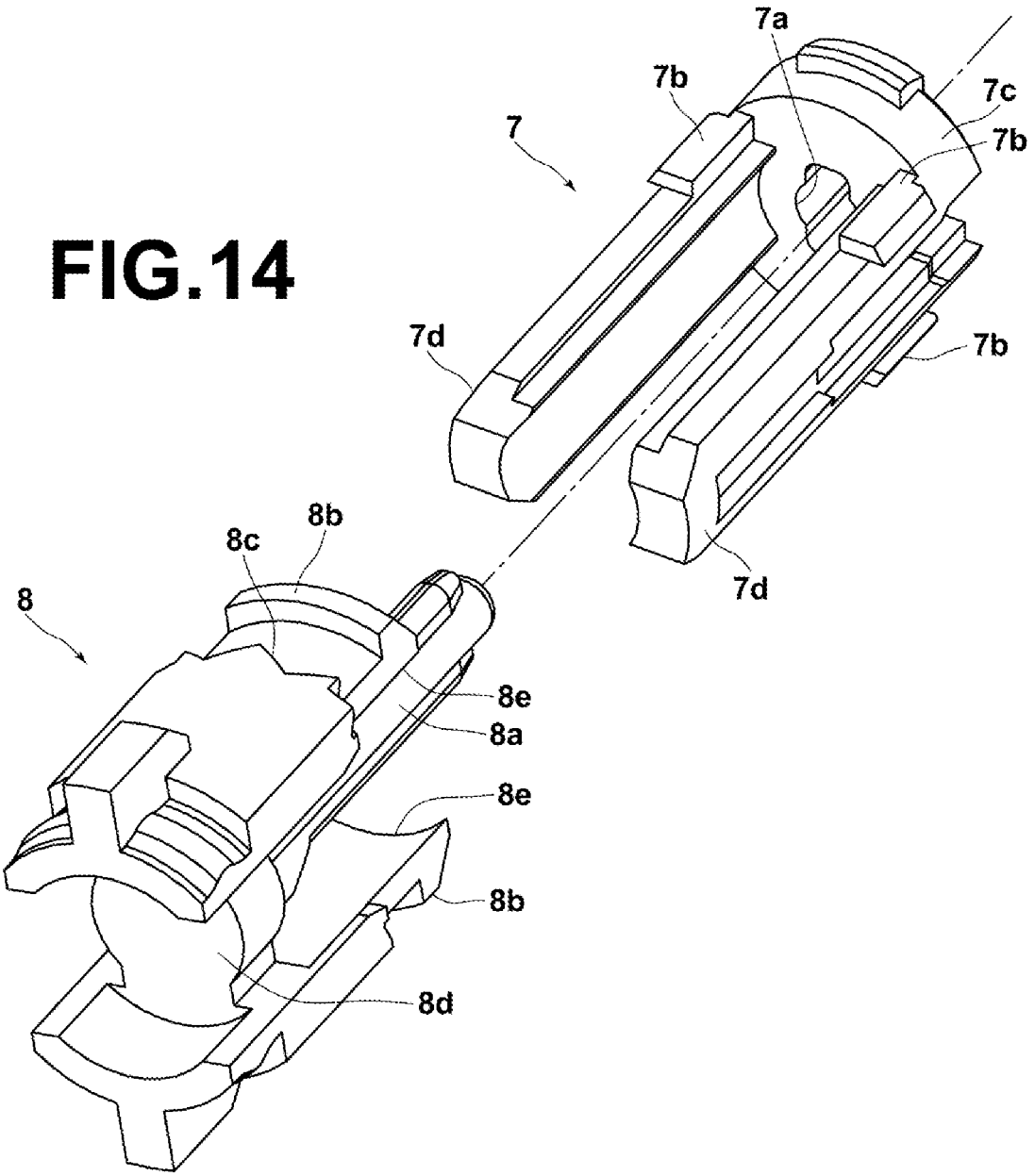
FIG. 14 is a perspective view of main component parts configuring the cosmetic material feeding-out container of FIG. 1.

A slide guide 7 is fixed below the cosmetic material container 4 in a state of being sandwiched between the two extended members 4*a*. A slide member 8 is disposed below the slide guide 7. FIG. 14 is a perspective view illustrating shapes and the detailed positional relationship of the slide guide 7 and the slide member 8 viewed from a substantially lower side of FIG. 13. In FIG. 14, a coil spring 9, to be described later, is omitted. As illustrated in the drawing, the slide guide 7 includes an upper plate 7*c*, and two longitudinal members 7*d* extended downwardly from the upper plate 7*c*. A guide hole 7*a* is formed by cutting through the central portion of the upper plate 7*c* and extended through the upper plate 7*c* along the upper to lower direction. Further, two convex members 7*b* are provided at an end portion of each of the longitudinal members 7*d* at the side of the upper plate 7*c* with interposing the longitudinal member 7*d* between the two convex members 7*b*. Further, the slide member 8 includes a base member 8*d*, and two clamp members 8*e* integrated with the base member 8*d* and extended upwardly (toward the slide guide 7). A long convex member 8*a* protruded upwardly is formed at the central portion of the base member 8*d*, and the convex member 8*a* is accommodatable inside the guide hole 7*a* of the slide guide 7. Further, the two clamp members 8*e* are spaced apart from each other to slidably clamp the two longitudinal members 7*d* of the slide guide 7 between the two clamp members 8*e*. With this configuration, the slide member 8 guided by the guide hole 7*a* is movable relative to the slide guide 7, that is, relative to the cosmetic material container 4, along the upper to lower direction.

The upper portion of the knocking operation piece 5 is fitted and fixed to the slide member 8. The coil spring 9 is disposed between the slide member 8 and the slide guide 7 in a state of compression. The slide member 8 and the knocking operation piece 5 are biased resiliently downwardly by the coil spring 9. However, as illustrated in FIG. 2A, since convex members 8*b*, formed outwardly at the upper left and right ends of the slide member 8, contact, from the upper side, a receiving member 3*b* formed inwardly at the lower portion of the intermediate tube 3, the biased slide member 8 and knocking operation piece 5 are prevented from downwardly coming out from the intermediate tube 3.

The cosmetic material 6 of stick shape is, for example, lipstick, but is not particularly limited thereto. Since the upper end of the cosmetic material 6 may be exposed from the inner tube 2, a cover 11 of cylindrical shape having a bottom, freely removeable and engageable to the outer tube 1, is typically provided.

An inner circumferential face of the intermediate tube 3, made of a member of cylindrical shape, is formed with a helical groove 3R by repeatedly winding a groove along a circumferential direction and a tube axial direction. The above-described engagement member 4*b* of the cosmetic material container 4 is configured to engage with the helical groove 3R. FIG. 3A and FIG. 3B, respectively, illustrate a perspective view near the lower end portion of the intermediate tube 3 viewed from an outer side, and a partial cut-away view near the lower end portion of the intermediate tube 3 viewed from an inner side. Further, FIG. 3C illustrates a cross sectional perspective view of the inner circumferential face of the outer tube 1 disposed outside the intermediate tube 3 by partially cutting-away the outer tube 1. For example, as illustrated in FIG. 3A and FIG. 3B, four cam convex members 3*a* of mountain-like shape are formed and arranged at an angular pitch of 90 degrees each other, and protruded downwardly at the lower end portion of the intermediate tube 3. More specifically, the cam convex member 3*a* includes a straight line portion extended along the axial direction of the intermediate tube 3, and an inclined face extended upwardly from the lower end of the straight line portion. Further, a plurality of cam crest members 3*c* are formed near the lower end portion of the intermediate tube 3 with protruded toward the center of the intermediate tube 3 with a given uniform thickness, from the inner circumferential face of the intermediate tube 3. These cam crest members 3*c* are formed, for example, at an angular pitch of 45 degrees, which means a total of eight cam crest members 3*c* are formed along the entire circumference of the intermediate tube 3.

As illustrated in FIG. 3C, a cam plate 20 having a given uniform thickness is formed on the inner circumferential face of the outer tube 1 with protruded toward the center of the outer tube 1. The cam plate 20 includes a groove portion 20*a*, cut relatively deeper from the upper end as straight-line portion along the axial direction of the outer tube 1, a first inclined member 20*b* extended obliquely downward from the upper end at one side edge of the groove portion 20*a* and relatively longer in the lateral direction, and a second inclined member 20*c* having a top position on a straight line elevated from the lower-most end of the first inclined member 20*b* and extended obliquely downward from such position and continued to the other side edge of the groove portion 20*a* with relatively shorter in the lateral direction. For example, the same one is repeated along the circumferential direction of the tube at an angular pitch of 90 degrees for each of the groove portion 20*a*, the first inclined member 20*b*, and the second inclined member 20*c* to form four groove portions 20*a*, four first inclined members 20*b*, and four second inclined members 20*c*. Further, the lower-most end of the first inclined member 20*b*, from which the second inclined member 20*c* is rising, is located at a position sufficiently higher than the bottom face of the groove portion 20*a*.

Figure 4:
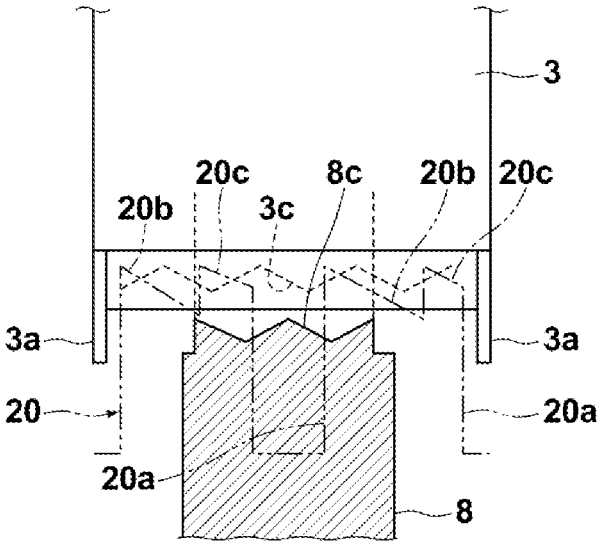
FIG. 4 is a front view illustrating a portion of the cosmetic material feeding-out container of FIG. 1.

FIG. 4 illustrates a schematic front view of near the lower end portion of the intermediate tube 3 and the above-described slide member 8 both viewed from an outer side. FIG. 4 illustrates a state that the intermediate tube 3 and the slide member 8 are not engaged with each other. Further, in FIG. 4, only two of the four cam convex members 3*a* are illustrated, and other two cam convex members 3*a* between them are omitted. Further, the cam crest member 3*c*, illustrated in FIG. 3B, is indicated with broken lines. As illustrated in FIG. 4, the slide member 8 includes a cam convex member 8*c* facing the cam crest member 3*c* illustrated in FIG. 3B. For the sake of description to be described later, in FIG. 4, the slide member 8 is particularly indicated with diagonal line, and the cam plate 20 of the outer tube 1, illustrated in FIG. 3C, is indicated with imaginary line.

Figure 5A:
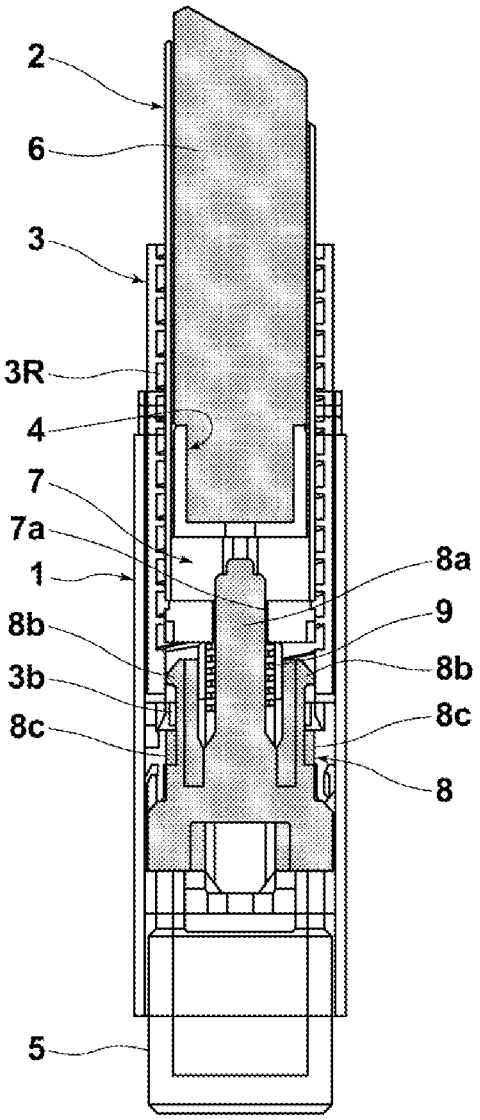
FIG. 5A is a cross-sectional side view of the cosmetic material feeding-out container of FIG. 1, illustrating another state different from FIG. 2A.
Figure 5B:
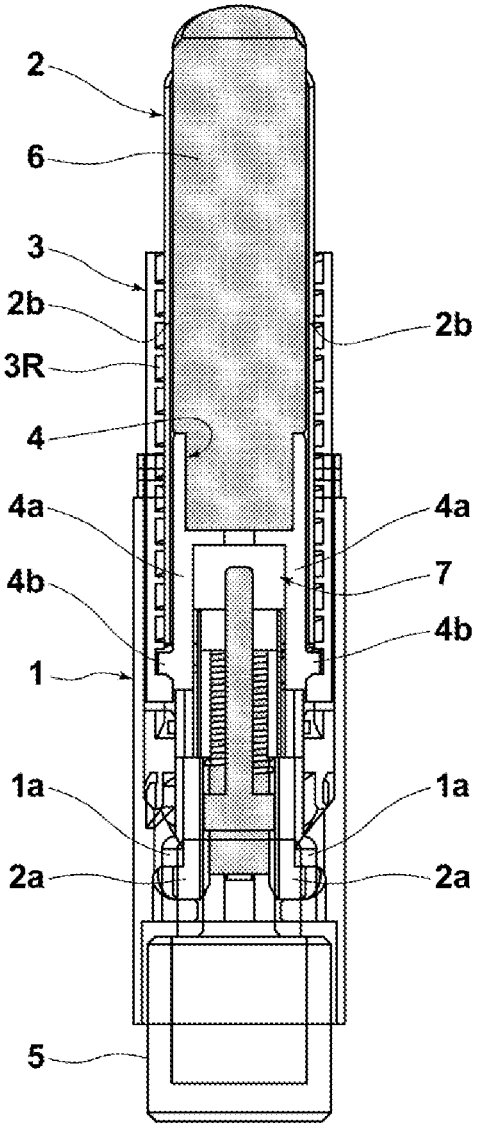
FIG. 5B is a cross-sectional front view of the cosmetic material feeding-out container of FIG. 1, illustrating another state different from FIG. 2B.

Hereinafter, a description is given of an interaction of the cosmetic material feeding-out container 10 employing the above-described configuration according to the first embodiment. FIG. 2A and FIG. 2B illustrate a state of accommodating the cosmetic material 6, held in the cosmetic material container 4, inside the inner tube 2 with not protruded upwardly from the inner tube 2. Hereinafter, this state is referred to as the "state when the cosmetic material being accommodated". On the other hand, the cosmetic material 6 can be in a state of slightly protruded upwardly from the inner tube 2 for providing a use by performing a given operation, to be described later. Hereinafter, this state is referred to as the "state when the cosmetic material being protruded". FIG. 5A and FIG. 5B, respectively, illustrate a cross-sectional side view and a cross-sectional front view of the cosmetic material feeding-out container 10 during a transition from the "state when the cosmetic material being accommodated" to the "state when the cosmetic material being protruded," and FIG. 6A and FIG. 6B, respectively, illustrate a cross-sectional side view and a cross-sectional front view of the cosmetic material feeding-out container 10 at the "state when the cosmetic material being protruded". The cross-sectional views illustrated in FIG. 5A and FIG. 6A are viewed same as the cross-sectional view illustrated in FIG. 2A, and the cross-sectional views illustrated in FIG. 5B and FIG. 6B are viewed same as the cross-sectional view illustrated in FIG. 2B.

Figure 6A:
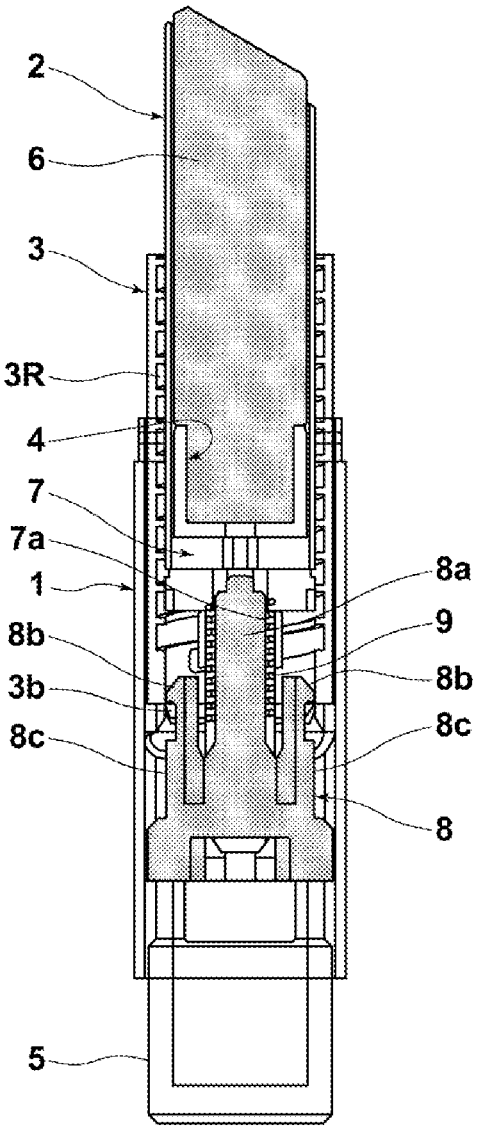
FIG. 6A is a cross-sectional side view of the cosmetic material feeding-out container of FIG. 1, illustrating still another state.
Figure 6B:
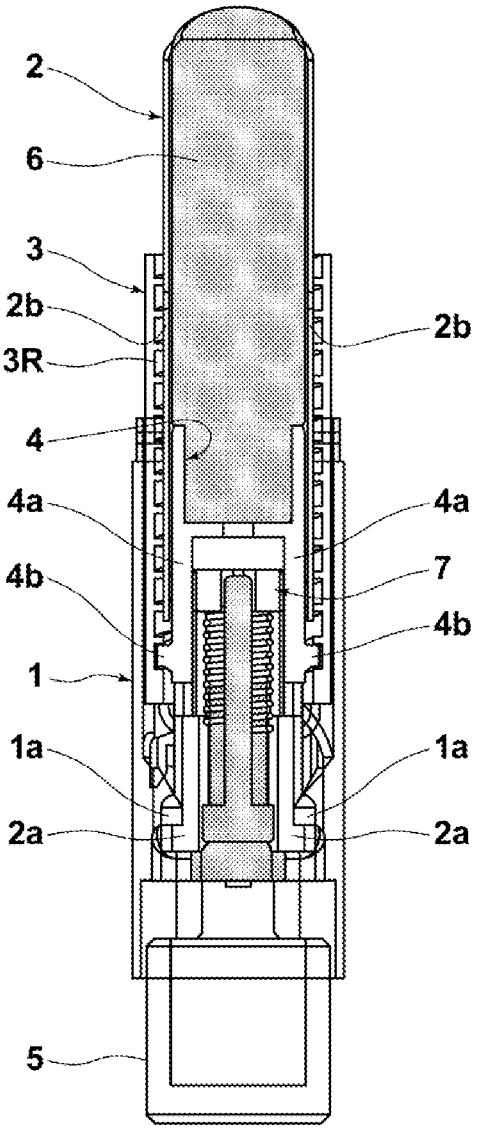
FIG. 6B is a cross-sectional front view of the cosmetic material feeding-out container of FIG. 1, illustrating still another state.
Figure 7:
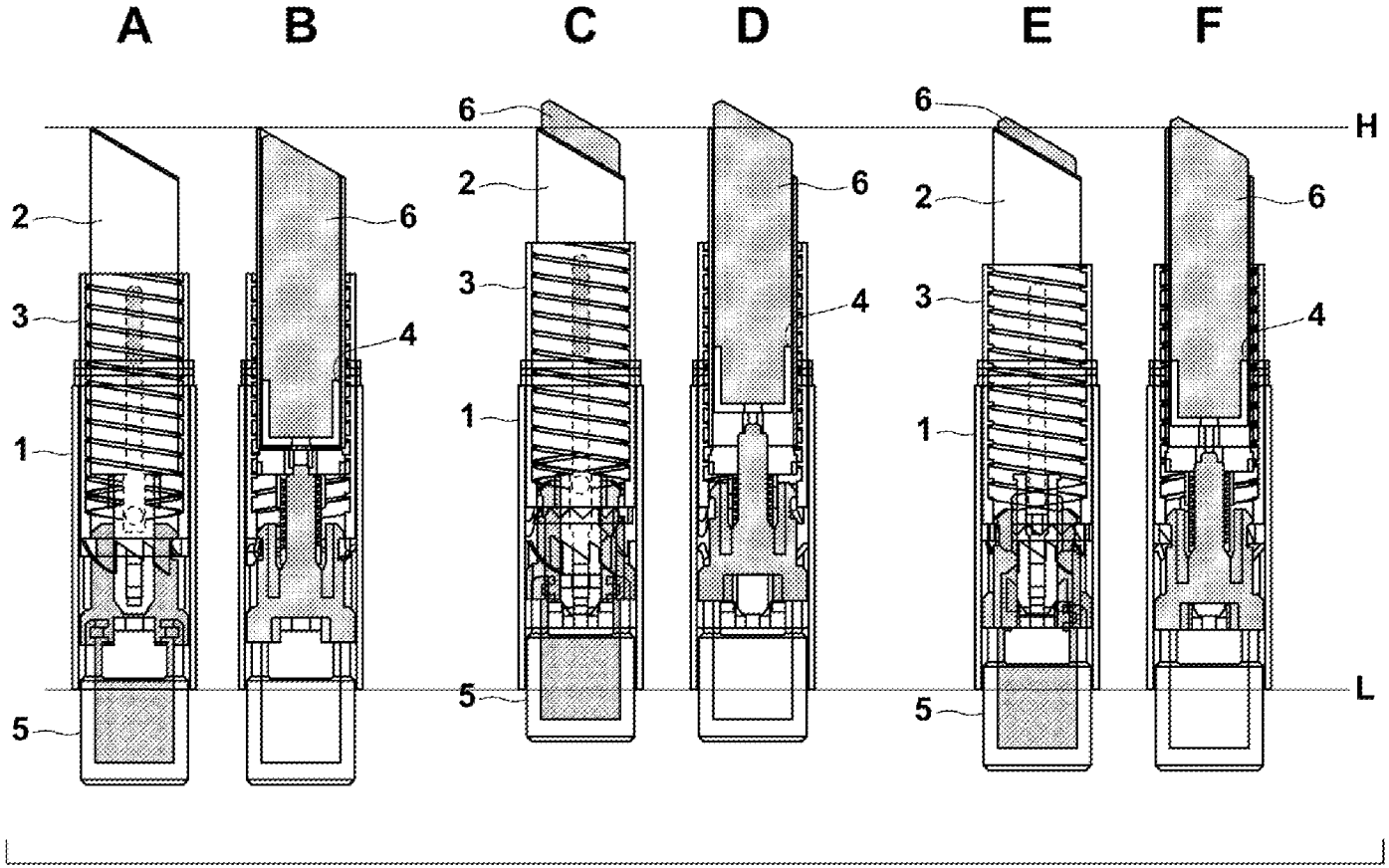
FIG. 7 is a schematic diagram illustrating three different states of the cosmetic material feeding-out container of FIG. 1.
Figure 12C:
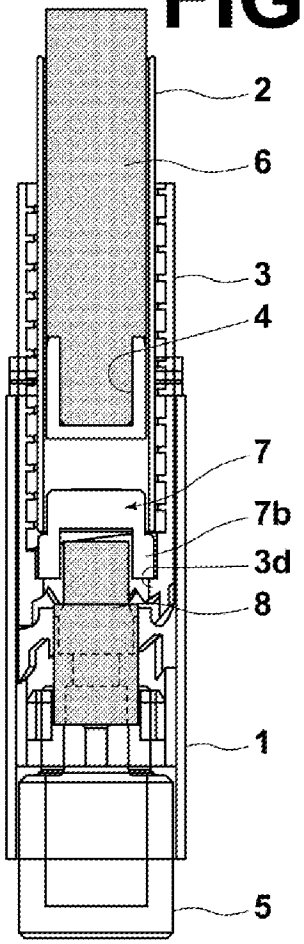
FIG. 12C is a cross-sectional view illustrating another state of the portion illustrated in the cross-sectional view of FIG. 12B.
Figure 12B:
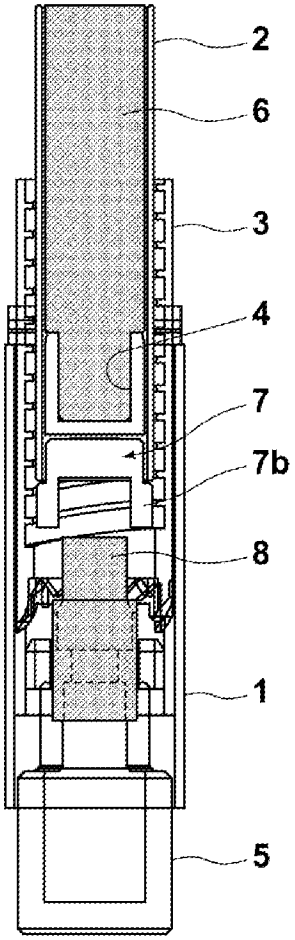
FIG. 12B is a cross-sectional view illustrating a portion along B-B line of the schematic side view of FIG. 12A.
Figure 12A:
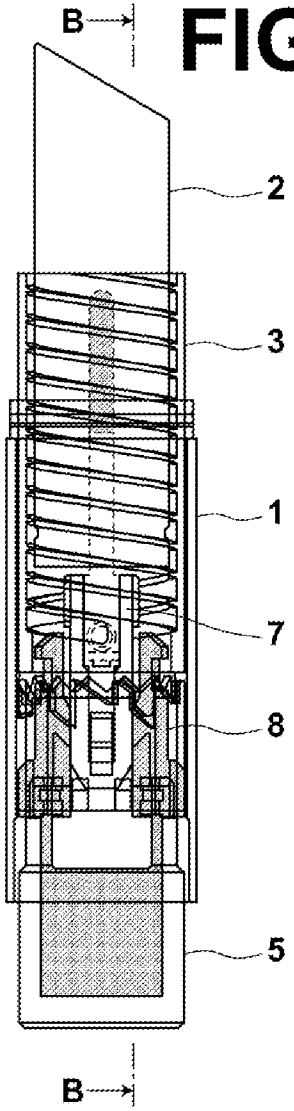
FIG. 12A is a schematic side view of the cosmetic material feeding-out container of FIG. 1.

Further, FIG. 7 schematically illustrates side views A, C, and E, and cross-sectional side views B, D, and F of the cosmetic material feeding-out container 10, corresponding to each of the states of FIGS. 2, 5, and 6 described above. Further, the cross-sectional views illustrated in B of FIG. 7, D of FIG. 7, and F of FIG. 7 are viewed same as the cross-sectional view illustrated in FIG. 2A. A of FIGS. 7 and B of FIG. 7 correspond to the state of FIG. 2A, C of FIGS. 7 and D of FIG. 7 correspond to the state of FIGS. 5A, and E of FIGS. 7 and F of FIG. 7 correspond to the state of FIG. 6A. Further, FIGS. 8 to 11 sequentially illustrate the positional relationship between the intermediate tube 3 and the slide member 8 during the transition from the "state when the cosmetic material being accommodated" to the "state when the cosmetic material being protruded" for the same portion illustrated in FIG. 4. FIGS. 12A-12C illustrate views mainly illustrating a convex member 7*b* of the above-described slide guide 7, in which FIG. 12A illustrates a side view including a cross section of B-B where the convex member 7*b* exists, FIG. 12B illustrates a shape view at the cross section of B-B, and FIG. 12C illustrates the view at the cross section of B-B in a state different from FIG. 12B. In FIGS. 12A-12C, the above-described coil spring 9 is omitted.

Figure 8:
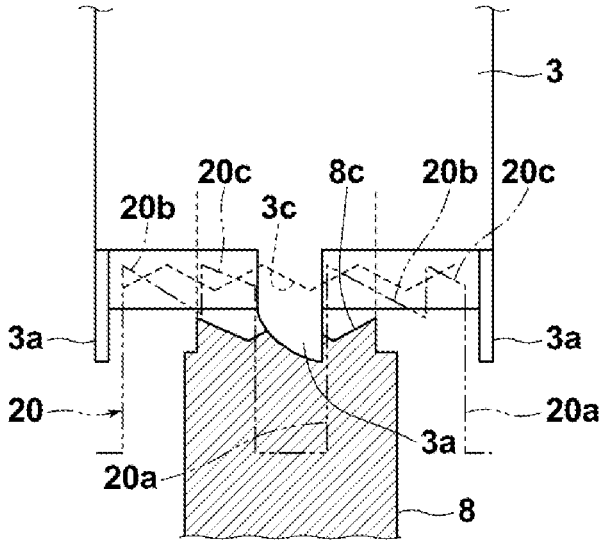
FIG. 8 is a partial front view illustrating one state of a main portion of the cosmetic material feeding-out container of FIG. 1.

When the cosmetic material is being accommodated, the cam convex member 3*a* at the lower portion of the intermediate tube 3, illustrated in FIGS. 3A-3C, is in a state of being inserted into the groove portion 20*a* of the cam plate 20. Further, the slide member 8 is being at a position away from the intermediate tube 3 downwardly. FIGS. 2 and 8 illustrate this state. If a user of cosmetic material performs a knocking operation (operation of pushing upward) of the knocking operation piece 5 against the elastic force of the coil spring 9 from this state, the cosmetic material container 4 is pushed up via the slide member 8 and the slide guide 7. With this operation, the cosmetic material container 4 slides and moves upwardly inside the inner tube 2. In this operation, the engagement member 4*b* of the cosmetic material container 4 moves within the guide space 2*b* of the inner tube 2. Further, the intermediate tube 3, which receives and engages the engagement member 4*b* in the helical groove 3R, also moves upwardly together with the cosmetic material container 4.

Figure 9:
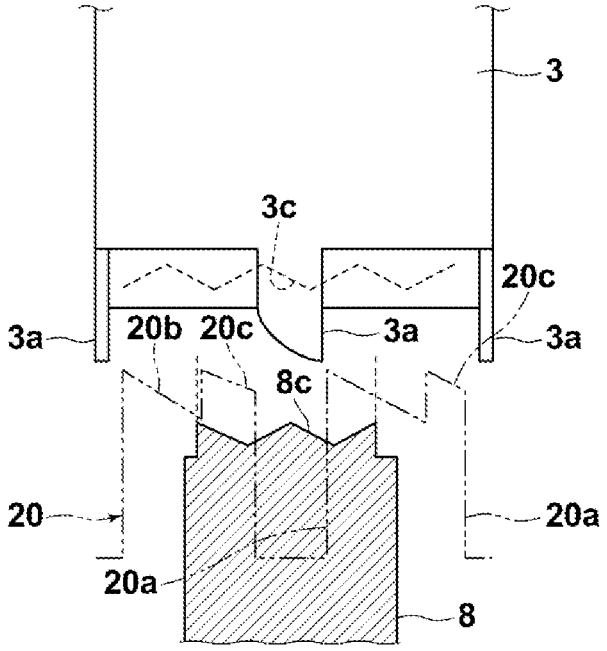
FIG. 9 is a partial front view illustrating another state of the main portion of the cosmetic material feeding-out container of FIG. 1, different from FIG. 8.
Figure 10:
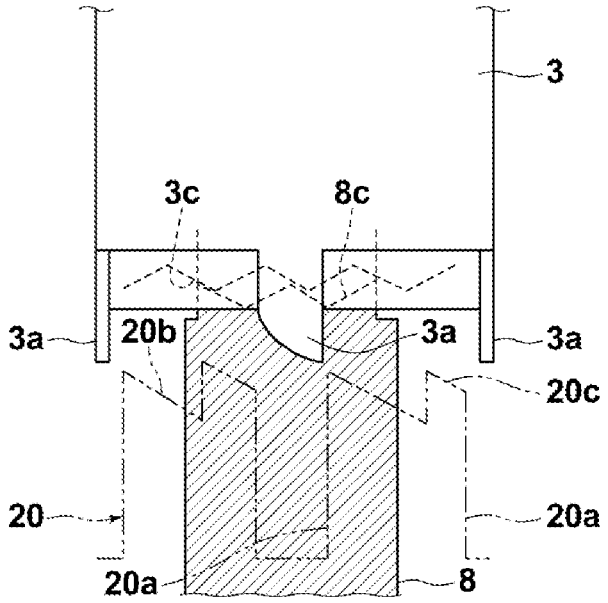
FIG. 10 is a partial front view illustrating still another state of the main portion of the cosmetic material feeding-out container of FIG. 1.
Figure 11:
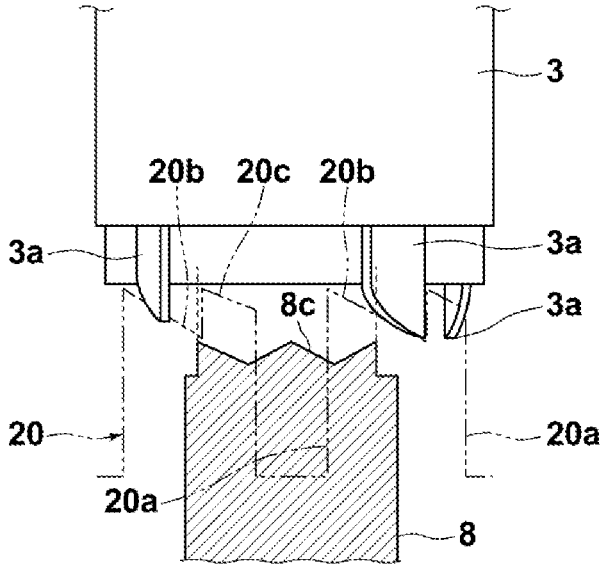
FIG. 11 is a partial front view illustrating further still another state of the main portion of the cosmetic material feeding-out container of FIG. 1.

Then, the intermediate tube 3 elevates to a level such that the cam convex member 3*a* of the intermediate tube 3 comes out from the groove portion 20*a* of the cam plate 20 upwardly (a state illustrated in FIG. 9). When the intermediate tube 3 has elevated to such level, as illustrated in FIG. 12C, a stopper member 3*d* protruded from the inner circumferential face at the lower end portion of the intermediate tube 3 abuts against the convex member 7*b* formed on the slide guide 7 (see FIG. 12C), with which a further elevation of the intermediate tube 3 is stopped. FIGS. 5A-5B illustrates a state when the intermediate tube 3, that is, the cosmetic material 6 has elevated to the highest position by performing the above-described operation. Then, if the knocking operation piece 5 is further pushed upwardly against the elastic force of the coil spring 9, the slide member 8 is elevated accordingly, and the cam convex member 8*c* formed on the upper portion of the slide member 8 presses the cam crest member 3*c* of the intermediate tube 3 from the below (a state illustrated in FIG. 10). Then, the cam crest member 3*c* moves into the right side in FIG. 10 along the cam convex member 8*c*, with which the intermediate tube 3 rotates into this direction. When the intermediate tube 3 rotates as such, the engagement member 4*b*, engaged with the helical groove 3R of the intermediate tube 3, moves upwardly, that is, the cosmetic material container 4 moves upwardly. Thus, the cosmetic material 6 held in the cosmetic material container 4 further protrudes upwardly from the inner tube 2.

When a user of cosmetic material feels that the cam crest member 3*c* has moved along the cam convex member 8*c*, or confirms that the cosmetic material 6 has protruded from the inner tube 2, the user releases the knocking operation piece 5. Then, the intermediate tube 3 descends such that the cam convex member 3*a* passes through the second inclined member 20*c* of the cam plate 20, and is then placed on the first inclined member 20*b* (more specifically, a state of aligning the straight line portion of the cam convex member 3*a* with the straight line portion of the second inclined member 20*c*), and then the intermediate tube 3 comes to rest (a state illustrated in FIG. 11). This state corresponds to the state when the cosmetic material being protruded described above, and the state illustrated in FIGS. 6A-6B. Further, in this case, the portion of the cross-sectional view illustrated in FIG. 12B becomes the state illustrated in FIG. 12C. In this state, since the cosmetic material 6 is protruded from the inner tube 2, the user of cosmetic material can use the cosmetic material 6, such as lipstick, for performing a make-up.

The amount of protrusion (height) of the cosmetic material 6 from the inner tube 2 when the cosmetic material being protruded can be set by totaling one protrusion amount of, for example, 2 mm, when the cam convex member 3*a* of the intermediate tube 3 rides on the first inclined member 20*b* of the cam plate 20 and the intermediate tube 3 is elevated to a position higher than a position when the cosmetic material being accommodated, and another protrusion amount of, for example, 0.5 mm, when the cosmetic material container 4 moves upwardly in response to the rotation of the intermediate tube 3, as the total amount of protrusion (height) of 2.5 mm. If the cosmetic material 6 is a lipstick, the protruded amount is preferably an amount that can be used up by performing one-makeup.

In the first embodiment, when the intermediate tube 3 is in the state illustrated in FIGS. 5 and 9, that is, when the cam convex member 3*a* comes out upwardly from the groove portion 20*a* of the cam plate 20, a user of cosmetic material can freely rotate the intermediate tube 3. Then, the intermediate tube 3 can be freely rotated in either any one of the directions to move the cosmetic material container 4 along the upper to lower direction, with which the amount of the cosmetic material 6 protruded from the inner tube 2 can be increased, or conversely, the excessively-protruded cosmetic material 6 can be retracted into the inner tube 2.

In the first embodiment, the intermediate tube 3 is rotatable by 45 degrees about the tube axis by performing one knocking operation of the knocking operation piece 5. Therefore, if the one knocking operation is further performed at the state when the cosmetic material being protruded, the intermediate tube 3 is rotated by 45 degrees in the same manner as described above, and then returns to the state when the cosmetic material being accommodated.

As described above, FIG. 7 illustrates the cross-sectional side view of the cosmetic material feeding-out container 10, corresponding to each state of FIGS. 2, 5, and 6 described above. In FIG. 7, in order to compare the height positions of each component part, the upper end position of the inner tube 2 and the lower end position of the outer tube 1, not moved by a knocking operation, are aligned for all of the states as indicated by lines H and L, respectively.

Although the mechanism illustrated in FIGS. 3 and 4 configure the rotating cam mechanism of the present disclosure, this type of rotating cam mechanism has been known to a person skilled in the art. Further, the arrangement angle of the cam elements in the rotating cam mechanism described above and the numbers of cam elements corresponding to the arrangement angle are depicted as merely one example, and it should be noted that these angle and numbers are not limited to those of the first embodiment.

Figure 15:
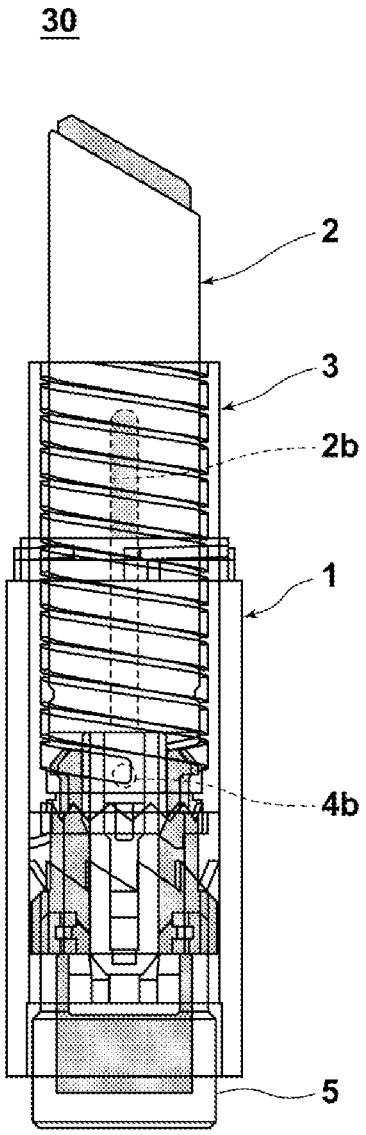
FIG. 15 is a side view illustrating a cosmetic material feeding-out container according to a second embodiment.

Hereinafter, a description is given of a cosmetic material feeding-out container 30 according to a second embodiment of the present disclosure. FIG. 15 is a side view illustrating an external appearance of the cosmetic material feeding-out container 30 according to the second embodiment. In FIG. 15 and the subsequent drawings, component elements equivalent to those in FIGS. 1 to 14 described above are denoted with the same reference numerals, and the description thereof will be omitted unless otherwise necessary. FIGS. 16A-16B are is cross-sectional views illustrating one state of the cosmetic material feeding-out container 30. FIG. 16A and FIG. 16B, respectively, illustrate a cross-sectional side view and a cross-sectional front view of the cosmetic material feeding-out container 30. Further, FIG. 17 C illustrates an inner circumferential face of the outer tube 1 disposed outside the intermediate tube 3 by partially cutting-away the outer tube 1. As illustrated in FIG. 17 C, a cam plate 20F is formed on the inner circumferential face of the outer tube 1 with protruded toward the center of the outer tube 1 with a given uniform thickness.

The cosmetic material feeding-out container 30 according to the second embodiment is basically different from the cosmetic material feeding-out container 10 of the first embodiment such that the cam plate 20F is different from the cam plate 20 illustrated in FIG. 3 C. That is, as similar to the cam plate 20 illustrated in FIG. 3 C, the cam plate 20F includes eight first inclined members 20*b* arranged in a state of repeating along the circumferential direction of the tube at an angular pitch of 45 degrees. Further, the mutual positional relationship between the near of lower end portion of the intermediate tube 3 and the slide member 8 in the second embodiment is similar to that illustrated in FIG. 4.

Figure 18:
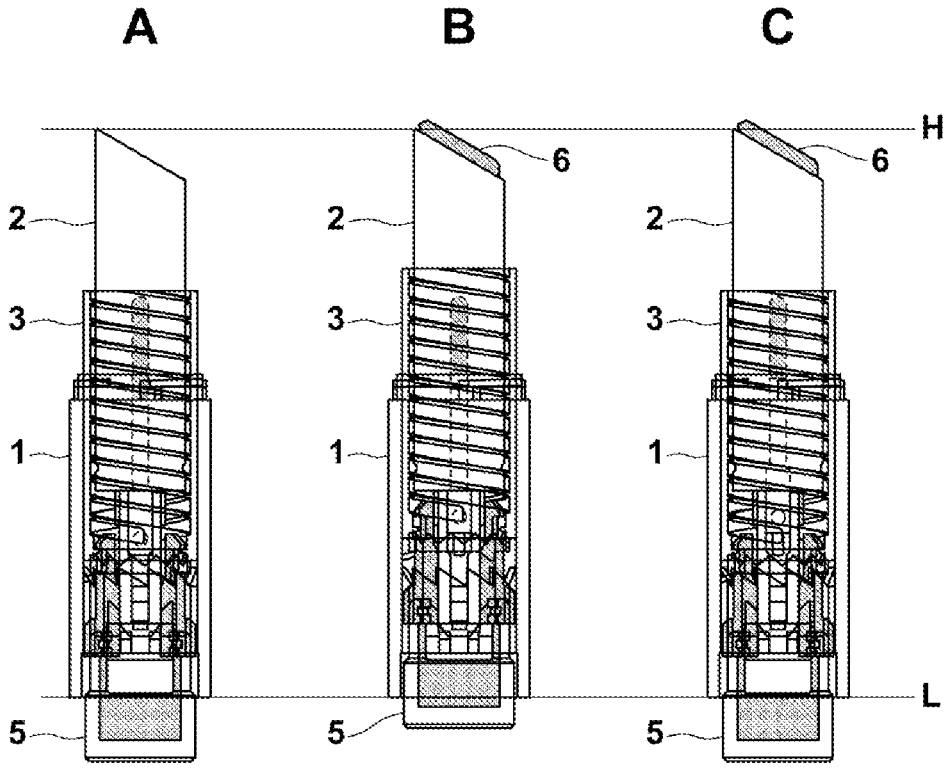
FIG. 18 is a schematic diagram illustrating three different states of the cosmetic material feeding-out container of FIG. 15.

Therefore, in the second embodiment, each time the knocking operation piece 5 is knock-operated, the four cam convex members 3*a* formed at the lower end portion of the intermediate tube 3 sequentially move onto the next first inclined member 20*b*, and thus the intermediate tube 3 rotates 45 degrees for each time. If a state when each of the four cam convex members 3*a* being placed on the first inclined member 20*b* is referred to as an initial state, the initial state is set for each time the knocking operation of the knocking operation piece 5 is performed. Also in this configuration, if the knocking operation piece 5 is pushed up completely between one initial state and the next initial state, the cam convex member 8*c* of the slide member 8 pushes up the cam crest member 3*c* of the intermediate tube 3 to the highest position, and thus the intermediate tube 3 and the cosmetic material container 4 (that is, the cosmetic material 6) can reach the highest position accordingly. When the knocking operation piece 5 is released after this state, the intermediate tube 3 and the cosmetic material container 4 slightly descend from the highest position and become the initial state. In FIG. 18, A of FIG. 18, B of FIG. 18, and C of FIG. 18, respectively, indicate the above-described initial state, the state that the intermediate tube 3 and the cosmetic material container 4 have reached the highest position, and the next initial state. C of FIG. 18— illustrates the state after performing the knocking operation for five times.

As can be understood from the above description, different from the first embodiment, in the second embodiment, the intermediate tube 3 is not configured to directly move relative to the inner tube 2 along the tube axial direction using the rotating cam mechanism. That is, in the second embodiment, the cosmetic material 6 is fed out from the inner tube 2 simply using the rotation of the intermediate tube 3 and the effect of the helical groove 3R. In this configuration, a user of cosmetic material may perform a knocking operation continuously with a greater force, and thus may feed out an excessive amount of the cosmetic material 6. Therefore, the amount of the cosmetic material 6, protrude-able from the inner tube 2 in response to the one knocking operation, may be preferably set relatively smaller.

The invention claimed is:

1. A cosmetic material feeding-out container comprising:

an outer tube of cylindrical shape;

an inner tube disposed inside the outer tube in a state of protruding a portion of the inner tube from one end of the outer tube, being integrated with the outer tube so as not movable relative to the outer tube;

a cosmetic material container disposed inside the inner tube, movable relative to the inner tube along a tube axial direction, accommodating a base end portion of cosmetic material of stick shape, and accommodating and holding the cosmetic material such that a tip end portion of the cosmetic material directing into a direction opposite with respect to another end of the outer tube;

an intermediate tube made of a member of cylindrical shape, disposed between the outer tube and the inner tube, formed with a helical groove extended in a circumferential direction and repeating along a tube axial direction on an inner circumferential face of the member of cylindrical shape;

an engagement member protruded from a portion of the cosmetic material container and engageable with the helical groove; and an operation unit including a knocking operation piece protruded from the another end of the outer tube, and a rotation cam mechanism configured to rotate the intermediate tube in response to a knocking operation of the knocking operation piece, wherein the intermediate tube is configured to be rotated by the rotating cam mechanism in response to the knocking operation of the knocking operation piece to move the cosmetic material container into a direction opposite with respect to the another end of the outer tube.

2. The cosmetic material feeding-out container according to claim 1, wherein the rotating cam mechanism is configured, in response to the knocking operation of the knocking operation piece, to rotate the intermediate tube and to move the intermediate tube relative to the inner tube along the tube axial direction.

3. The cosmetic material feeding-out container according to claim 2, wherein the inner tube is provided with a guide space, formed by cutting away a portion of a tube wall of the inner tube and being extended along a tube axial direction, and the engagement member is moveable within the guide space.

4. The cosmetic material feeding-out container according to claim 3, wherein the engagement member includes two engagement members being protruded in opposite directions with the center of a cosmetic material container interposed between the two engagement members.

5. The cosmetic material feeding-out container according to claim 2, wherein the engagement member includes two engagement members being protruded in opposite directions with a center of the cosmetic material container interposed between the two engagement members.

* * * * *